US006916128B1

(12) United States Patent
Petteruti et al.

(10) Patent No.: US 6,916,128 B1
(45) Date of Patent: Jul. 12, 2005

(54) PRINTER ATTACHABLE TO VARIOUS MODELS AND TYPES OF PORTABLE DEVICES AND TERMINALS FOR OPERATION THEREWITH

(75) Inventors: Robert Petteruti, E. Greenwich, RI (US); Steven F. Petteruti, E. Greenwich, RI (US); David Beck, Exeter, RI (US)

(73) Assignee: ZIH Corp., Hamilton (BE)

( * ) Notice: Subject to any disclaimer, the term of this patent is extended or adjusted under 35 U.S.C. 154(b) by 0 days.

(21) Appl. No.: 10/313,425

(22) Filed: Dec. 6, 2002

Related U.S. Application Data

(60) Provisional application No. 60/338,870, filed on Dec. 7, 2001.

(51) Int. Cl.[7] ..... B41J 3/36
(52) U.S. Cl. ..... 400/88; 400/691; 400/692
(58) Field of Search ..... 400/88, 691–693; 361/686

(56) References Cited

U.S. PATENT DOCUMENTS

| | | | | |
|---|---|---|---|---|
| 4,881,839 A | | 11/1989 | Grimm | 400/692 |
| 5,122,005 A | | 6/1992 | Kamei | 400/691 |
| 5,209,583 A | | 5/1993 | Lewis et al. | 400/88 |
| 5,267,800 A | | 12/1993 | Petteruti et al. | 400/88 |
| 5,290,178 A | * | 3/1994 | Ma | 439/652 |
| 5,503,483 A | * | 4/1996 | Petteruti et al. | 400/88 |
| 5,520,470 A | * | 5/1996 | Willett | 400/88 |
| 5,644,471 A | * | 7/1997 | Schultz et al. | 361/686 |
| 5,699,226 A | * | 12/1997 | Cavello | 361/686 |
| 5,764,475 A | | 6/1998 | LeVander | 361/683 |
| 5,805,807 A | * | 9/1998 | Hanson et al. | 370/340 |
| 5,806,993 A | | 9/1998 | Petterutti et al. | 400/88 |
| 5,816,725 A | | 10/1998 | Sherman et al. | 400/88 |
| 6,004,053 A | | 12/1999 | Petteruti et al. | 400/693 |
| 6,081,594 A | * | 6/2000 | Tseng | 379/420.02 |
| 6,208,427 B1 | | 3/2001 | Lee | 358/1.15 |
| 6,234,389 B1 | | 5/2001 | Valliani et al. | 235/380 |
| 6,270,271 B1 | | 8/2001 | Fujiwara | 400/693 |
| 6,301,106 B1 | * | 10/2001 | Helot et al. | 361/686 |
| 6,409,401 B1 | | 6/2002 | Petteruti et al. | 400/88 |
| 6,594,548 B2 | * | 7/2003 | Bagnordi | 700/233 |
| 6,652,170 B1 | * | 11/2003 | Arnold | 400/88 |

FOREIGN PATENT DOCUMENTS

JP 2002221760 A * 8/2002 ..... B03B 27/32

OTHER PUBLICATIONS

Monarch 6015, Barcoding.com, Printout from web site www.autoid.com/detail monarch6015.htm, Mar. 3, 2003.
Monarch HandiPrint 6017 Handheld Printer, Monarch Marking Systems, Inc., 2000.

* cited by examiner

*Primary Examiner*—Minh Chau
(74) *Attorney, Agent, or Firm*—Alston & Bird LLP

(57) ABSTRACT

A portable printer which can be removably attached to a variety of models and types of portable devices, such as Personal Digital Assistants (PDAs), cell phones, or other terminal devices. The portable devices can be attached to the portable printer via a clip-on adapter, thereby providing a universal clip-on printer. The adapter can take on a variety of shapes to hold the device and is unique for the model and type of each portable device, and contains mating electronic interconnectivity to electrically, wirelessly, or optically connect the portable device to the portable printer to enable communication between the portable device and the portable printer. The portable device connected to the portable printer can operate the portable printer in a controlling relationship.

54 Claims, 9 Drawing Sheets

PRINTER ATTACHABLE TO VARIOUS MODELS AND TYPES OF PORTABLE DEVICES AND TERMINALS FOR OPERATION THEREWITH

This application claims the benefit of priority to U.S. Provisional Patent Application No. 60/338,870, filed Dec. 7, 2001, which is herein incorporated by reference.

FIELD OF THE INVENTION

The present invention relates to printers, particularly miniature portable printers which can be hand-held, and which printers are adapted to be physically and electrically connected to a plurality of different models and types of portable data handling or communication devices, sometimes called personal devices, because of their small size which enables the devices to be hand-held and/or carried in a user's pocket. Such portable devices include personal digital assistants and miniature personal computers (both usually called PDAs), cellular telephones, and other terminal and display devices. The printer is provided in accordance with the invention with a mounting mechanism which functions as an adapter to enable removable attachment of the portable device to the printer and operation therewith. Since the mounting mechanism provides a removable attachment for the portable device, it is referred to herein for convenience as a "clip-on", and the printer may be called a "clip-on printer".

BACKGROUND OF THE INVENTION

The printers, which are embodied in the invention, may be miniature, portable printers which have been used on factory floors, in warehouses, and in retail establishments for ticket printing and inventory control. For example, such portable printers are described in U.S. Pat. Nos. 6,004,053, 5,806,993, and 5,267,800, and in the Monarch Model 6015 and 6017 printer data sheets. These printers print indicia, such as text, barcodes, or graphics, on media, such as adhesive-back label stock or paper, from a roll in the printer's housing. Being miniature, such portable printers, compared to heavier stationary or briefcase printers, are of a small weight and size to be easily carried, worn by a user.

Portable printers may be attached to portable devices, such as terminals or Personal Data Assistant (PDA), such as described, for example, in U.S. Pat. Nos. 6,270,271, 5,816,725, 5,209,583, and 4,881,839. However, these portable printers are limited for use with a particular model or type of portable device, and have no facility for allowing a user to easily attach different models, types, or kinds of portable devices for use with the printer. Thus, it would be desirable to provide a portable printer easily attachable to different models, types, or kinds of portable devices.

SUMMARY OF THE INVENTION

Accordingly, it is an object of the present invention to provide a portable printer that attaches to a variety of different models, types, or kinds of portable devices via interchangeable adapters.

It is another object of the present invention to provide a portable printer attachable to one of a variety of portable devices by providing an adapter that releasibly attaches the portable device to the portable printer to enable the portable device to connect with the portable printer such that portable printer can operate responsive to the portable device.

It is a further object of the present invention to provide a portable printer attachable to one of a variety of different portable devices which can utilize data entry facilities provided in the housing of the portable printer.

It is yet another object of the present invention to provide a portable printer attachable to one of a variety of different portable devices which can utilize communication facilities, such by radio (RF) or infrared (IR), provided in the housing of the portable printer.

Briefly described, the invention embodies a universal clip-on portable printer having a print engine with a housing, and one of multiple adapters releasibly attached to the housing, where each of the adapters is capable of connecting a different model, type, or kind of portable device for communication with the portable printer. Portable devices may represent a Personal Data Assistant (PDA), cell phone, portable data handling terminal, or hand-holdable computer or data processing unit. Each adapter is shaped to hold the model, type, or kind of portable device for use with the adapter, and contains mating electronic interconnectivity to electrically, wirelessly, or optically connect the portable device to the portable printer to enable communication between the portable device and the portable printer. A portable printer equipped with such an adapter may be called a universal clip-on printer as it is attachable to different portable devices by either using the same adapter with portable devices of similar model and type, or interchanging the adapter with different adapters for different models, types, or kinds of portable devices. The portable device so attached to the portable printer can operate the portable printer in a controlling relationship to print indicia, such as text, barcodes, or graphics.

When a portable device is connected to the portable printer, the portable printer can determine the type of portable device connected to the printer and whether the portable device has the proper driver software for enabling communication with the portable printer. If needed, the portable printer can transmit such driver software into memory of the portable device to enable the portable device to communicate with the portable printer, or a user may load driver software to the portable device, such as by using a personal computer system typically programmed to communicate with the portable device when coupled or docked thereto.

The portable printer may have one or more data entry facilities to provide information that may be communicated to the portable device when attached to the portable printer. For example, data entry facilities may represent IR circuitry, magnetic card reader, smart card reader/writer, RFID Tag reader/writer, image scanner, or radio (RF), which may optionally be present in the housing of the portable printer. Further, the portable device may communicate with the portable printer using such radio or IR enabled facilities, and the portable device may utilize said communication facilities of the portable printer to communicate with devices other than the printer.

A method is also provided by the present invention for a universal clip-on portable printer by: attaching a portable device adapter to a portable printer; locating a portable device in the adapter to provide one of electrical, RF, or optical connection between the portable device and the printer; determining the type of portable device in the adapter, and communicating commands and data between the portable device and printer in accordance with the type of portable device. When a user desires to use a different portable device which necessitates the use of another adapter, the method further provides: replacing the adapter with a different adapter for attachment of the different portable device to the portable printer; locating the different portable device in the different adapter; and repeating the determining and communicating steps with the different portable device. Optionally, the portable device may be located in the adapter when the adapter is attached (or clipped onto) the portable printer.

BRIEF DESCRIPTION OF THE DRAWINGS

The foregoing objects, features and advantages of the invention will become more apparent from a reading of the following description in connection with the accompanying drawings, in which.

DETAILED DESCRIPTION OF THE INVENTION

Figure 1:
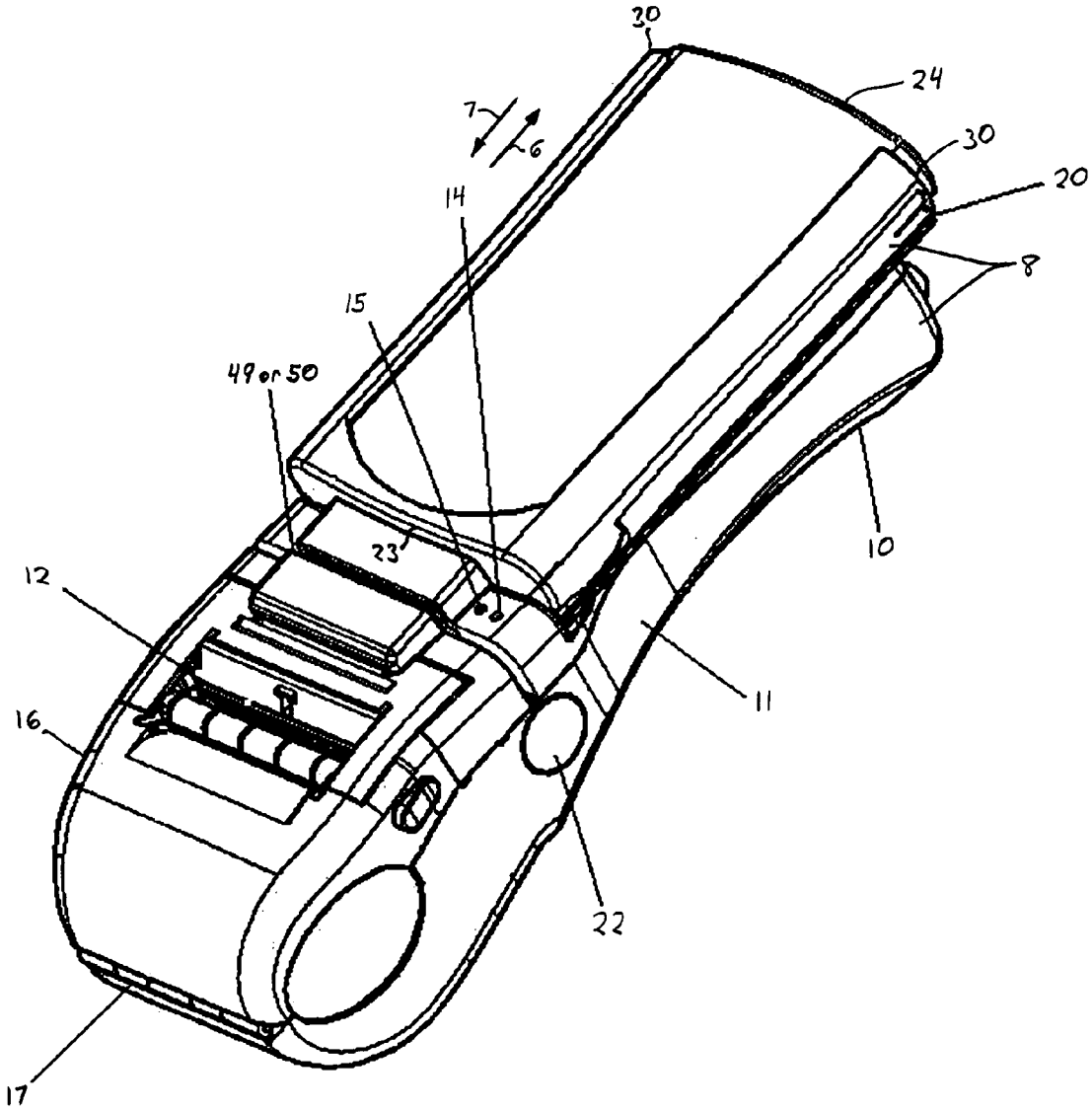
FIG. 1 is a diagrammatic view of a universal clip-on printer according to the present invention showing a portable device attached to the printer.
Figure 1A:
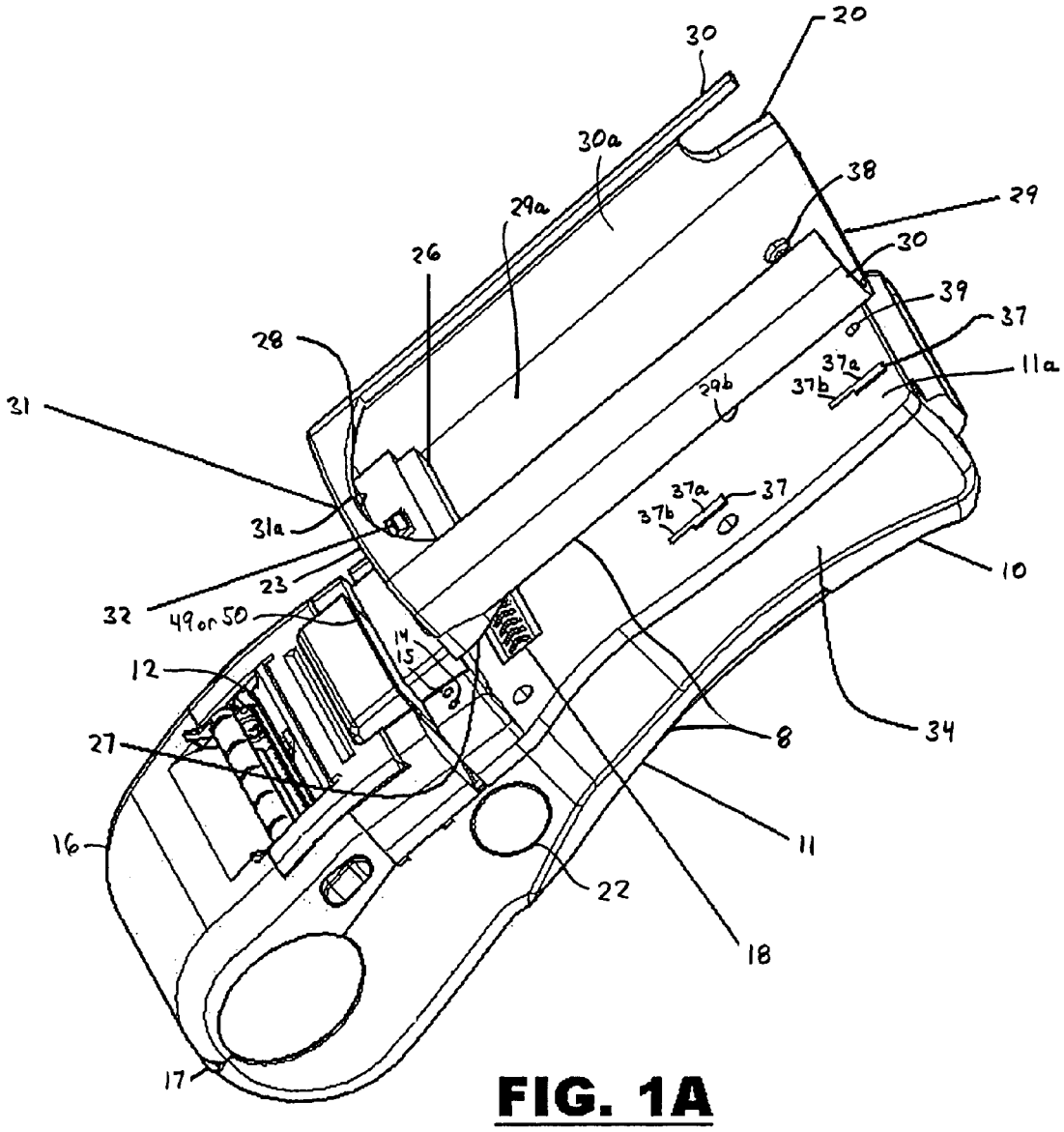
FIGS. 1A and 1B are exploded view of the universal clip-on printer of FIG. 1 from a top and bottom perspective, respectively, with the portable device of FIG. 1 removed from the printer.
Figure 1B:
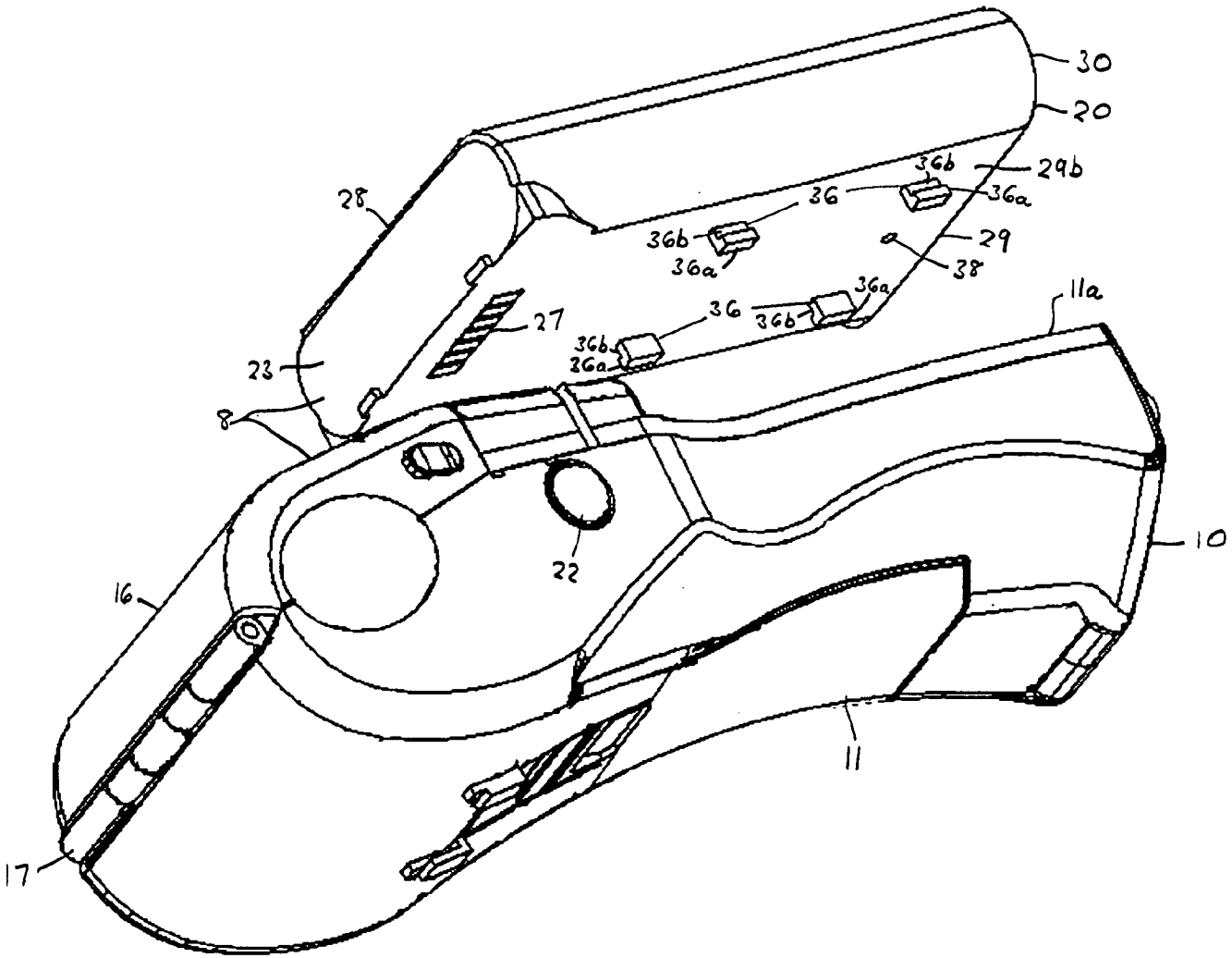

Referring to FIGS. 1, 1A, 1B and 3, a portable printer 8 provides a common print engine 10 having a housing 11 with a print head 12, a power indicator LED (light emitting diode) 14, an online/status LED 15, a media cover 16, a media cover hinge 17, a universal docking connector 18 (FIG. 1A), a battery 19 (FIG. 3), a platen 21 (FIG. 3), a media cover release latch 22, and a portable device adapter 20 fixably mounted stationary to housing 11 and releasably there from. The portable device adapter 20 represents a cradle, sled, clip, or other portable device holder having a housing shaped to receive a portable device 24 and clip-on attach to housing 11. As best shown in FIGS. 1A and 1B with the adapter 20 detached from the housing 11 and the portable device 24 removed, portable device adapter 20 interfaces with the portable device 24 via a device docking connector 26 (e.g., pins or contacts) which mates with the input/output (I/O) connector(s) or port of the portable device 24.

Connector 26 may be located in the interior of the adapter 20 on either on the top 28, bottom 29 (along bottom surface 29*a*), sides 30 (along side surfaces 30*a*), or back wall 31 (along surface 31*a*) of the adapter, depending on the I/O connector orientation of the portable device 24. The adapter 20 may contain an optional detenting latch or hook 32 which can be received in a ledge or groove along the portable device's housing to prevent the portable device from falling out of the adapter 20 if inverted, or accidentally jarred. However, other latching means may be used to retain the portable device 24 in adapter 20 depending on whether the portable device has hook(s), slots, or tracks, to be received in corresponding groove(s) or ridge(s) which may be provided along the adapter's interior. The portable device 24 can be a PDA, cell phone, or other portable terminal, such as the Hewlett Packard Journada Model 500 series, Compaq Model iPAQ, Symbol Model SPT-2800, Nokia, Ericsson, or Motorola cell phones. The adapter 20 may be provided by a single piece of molded plastic. The portable device adapter 20 provides the mounting mechanism or "clip-on" for the portable printer. Together, the common print engine 10 and portable device adapter 20 weigh less than two pounds.

Within the housing 11 of common print engine 10 is contained the printer electronics 34 and printer mechanism. The printer mechanism includes print head 12 and a motor for driving platen roller 21 to advance the media across the print head 12, upon which media, indicia, such as text, graphics, or barcodes may be printed. Media access cover (or door) 16, to which the platen roller 21 is mounted, permits easy loading of the various media. The media is usually in the form of a roll, which is contained in housing 11. The housing 11 may further have windows 16*a*, such as of plastic, coupled to sides of cover 16 as shown best in FIG. 5.

The print engine 10 is referred to as a common print engine in that it can be connected to different portable devices 24 by the use of an adapter 20 appropriate for connecting the portable device to the printer 8. Thus, depending on the portable device 24, different ones of adapter 20 may be used having the appropriate interface connector 26 for communication with the portable device 24. However, a single adapter 20 may be used with different portable devices 24 of similar model having the same I/O connector(s) or port for mating with interface connector 26. The device docking connector 26 is connected to an adapter docking connector 27, such as by either a flex cable, or printed circuit board fastened to the portable device adapter 20. Either connection means may be provided along a recess or housed in a compartment at end 20*a* of the adapter 20, or other similar connection means may be used for proper electrical connection between the connectors 26 and 27.

The adapter connector 27 is located along the outer surface 29*b* of bottom wall 29 so that when the adapter 20 is attached to the print engine 10, as described below, surface 29*b* lies adjacent and facing the upper surface 11*a* of housing 11, and universal docking connector 18 aligns and mates with the corresponding adapter docking connector 27. Although the connectors 18, 26, and 27 are shown as physical (electrical-based) connections, connector 26 may be an optical connector for communication to an optical port of the portable device 24, such as by IR (Infrared) light, or connectors 18 and 27 may be optical connectors enabling communication by IR light.

As best shown in FIG. 1B, the adapter 20 is attached or mounted to the print engine's housing 11 by latch keys 36 extending from the outer surface 29*b* of bottom wall 29 of adapter 20 towards housing 11. The portable device adapter 20 is affixed to the print engine 10 by aligning and inserting the latch keys 36 into key slots 37 of housing 11. Each slot 37 has an opening (or first slot) 37*a* sized to receive the base 36*a* of key 36, such that the key 36 may be pushed into a narrower opening (or second narrow slot) 37*b* which extends from opening 37*a* to capture the neck 36*b* of key 36. Although four slots 37 are shown for receiving a corresponding number of keys, other number of, or different oriented slots and corresponding keys may be used. Such mounting means enables the adapter 20 to be easily removable from housing 11 and replaced with another adapter. An optional detecting latch 38 may be provided on the adapter 20 which can be aligned and coupled to an extending portion or bump 39 from housing 11.

As stated earlier, the universal docking connector 18 aligns and mates with the corresponding adapter docking connector 27 when the adapter 20 is attached to print engine 10. Thus, when the portable device 24 is inserted in adapter 20, the device docking connector 26 aligns and mates with the I/O connector(s) of the portable device 24, thereby enabling the portable device 24 to communicate with the print engine 10 via docking connectors 18, 26 and 27.

Figure 2:
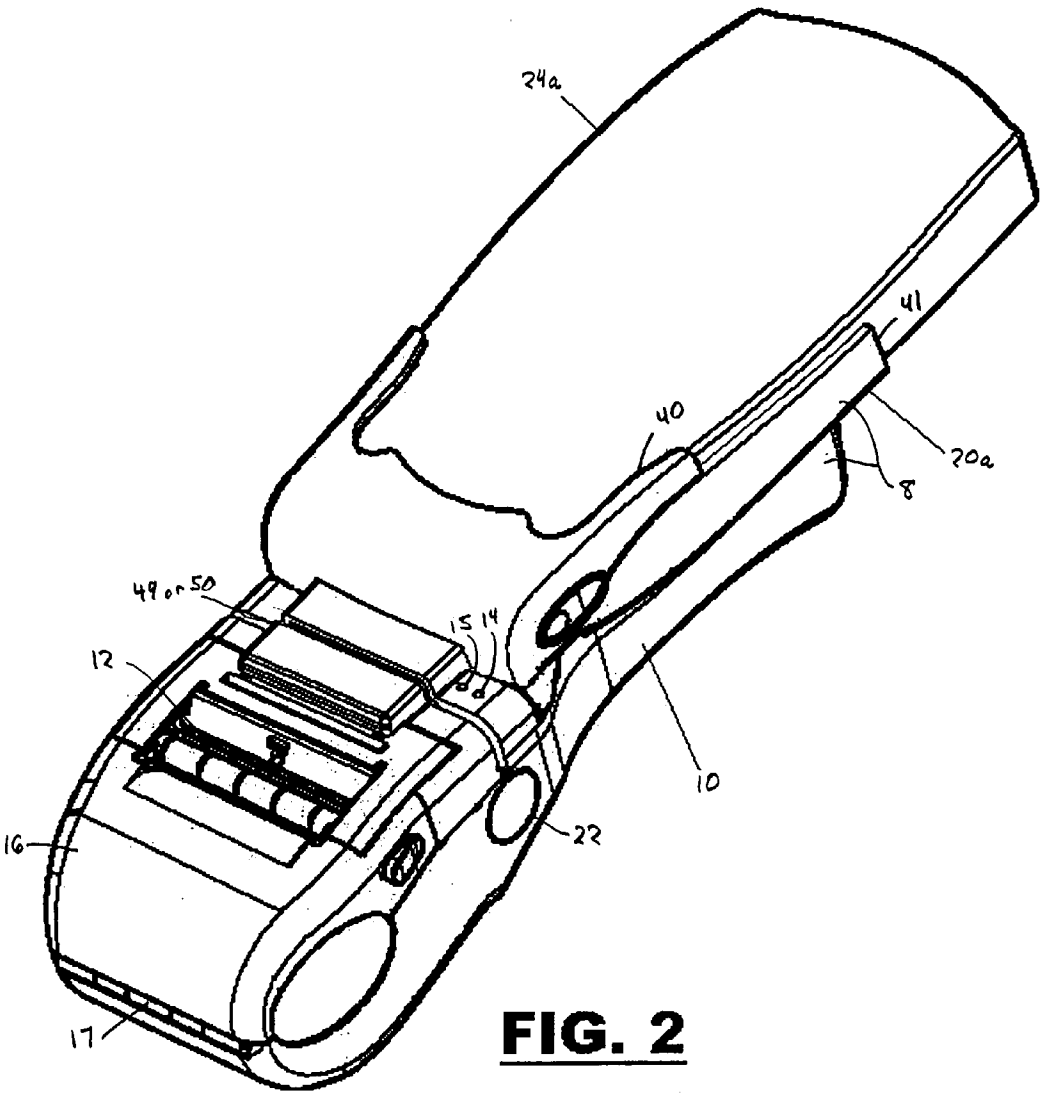
FIG. 2 is the universal clip-on printer of FIG. 1 with another portable device adapter.
Figure 2A:
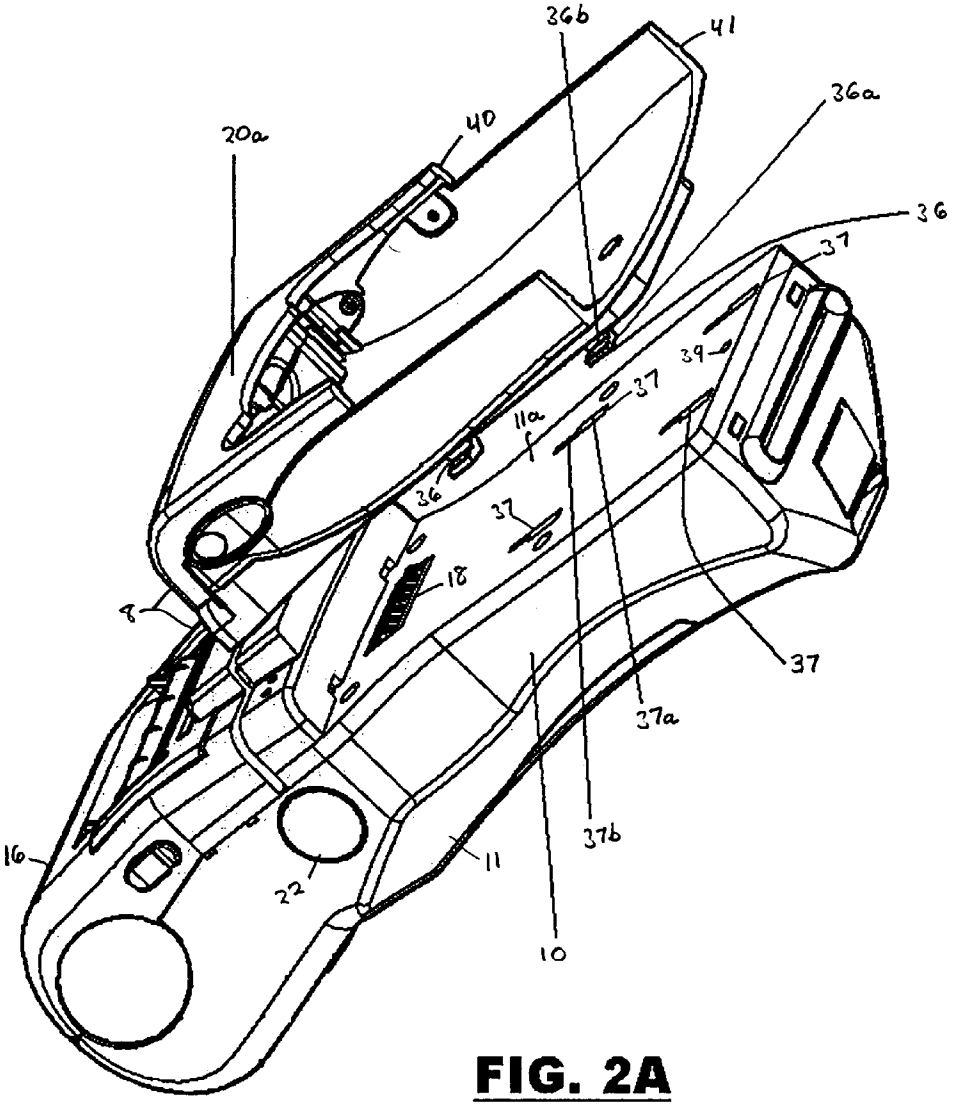
FIG. 2A is an exploded view of the universal clip-on printer of FIG. 2.
Figure 3:
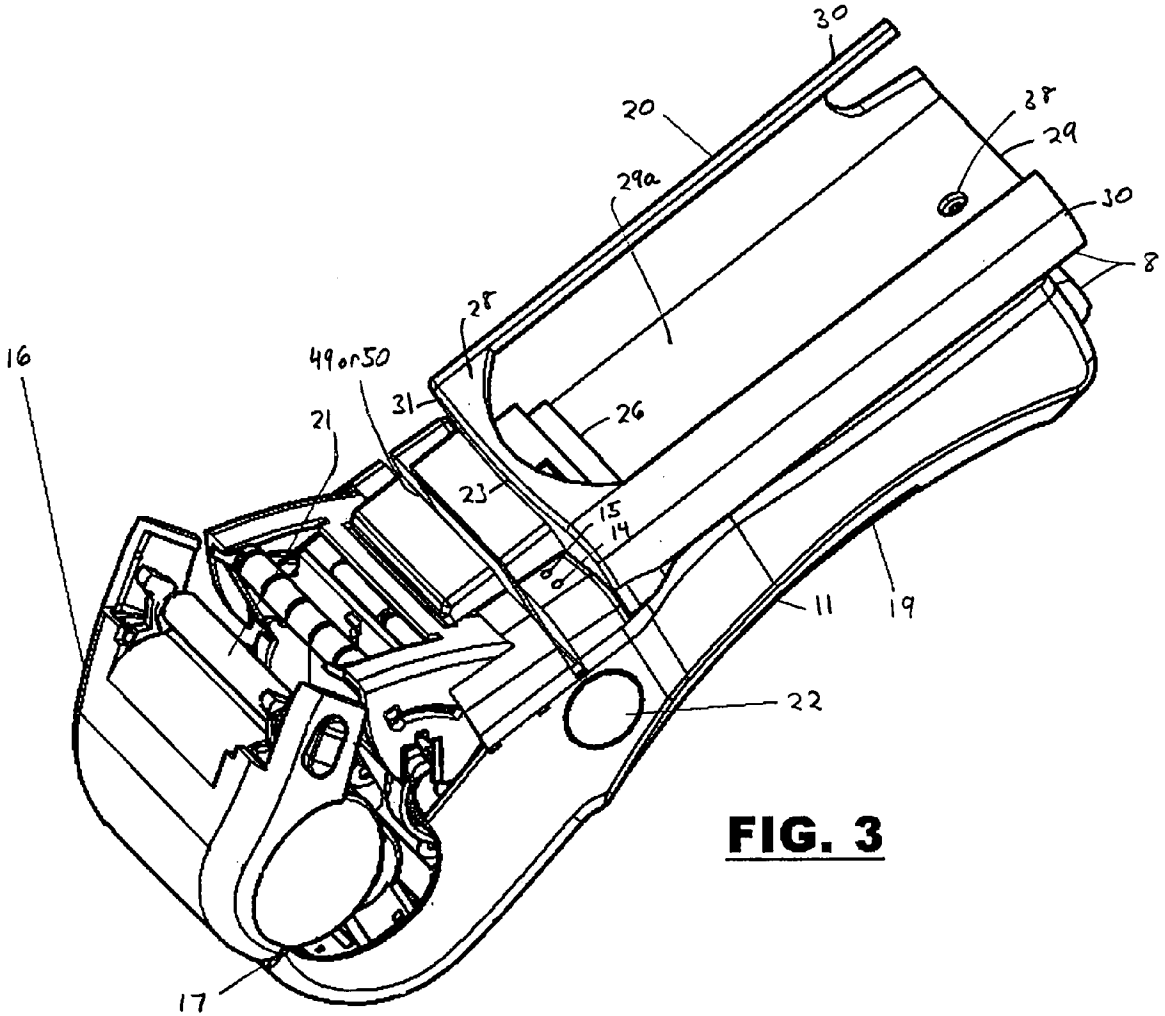
FIG. 3 is another view of the universal clip-on printer of FIG. 1 showing the media cover in an open position.

Referring to FIGS. 2 and 2A, a common print engine 10 is depicted with another portable device adapter 20*a* mounted to provide portable printer 8. The portable device adapter latch keys 36 are depicted which insert into the key slots 37 when the adapter 20*a* is docked to the common print engine 10, such as described earlier for device adapter 20. The adapter 20*a* may be made by a single piece of molded plastic, or a two-piece assembly 40, 41 of molded plastic.

Figure 4:
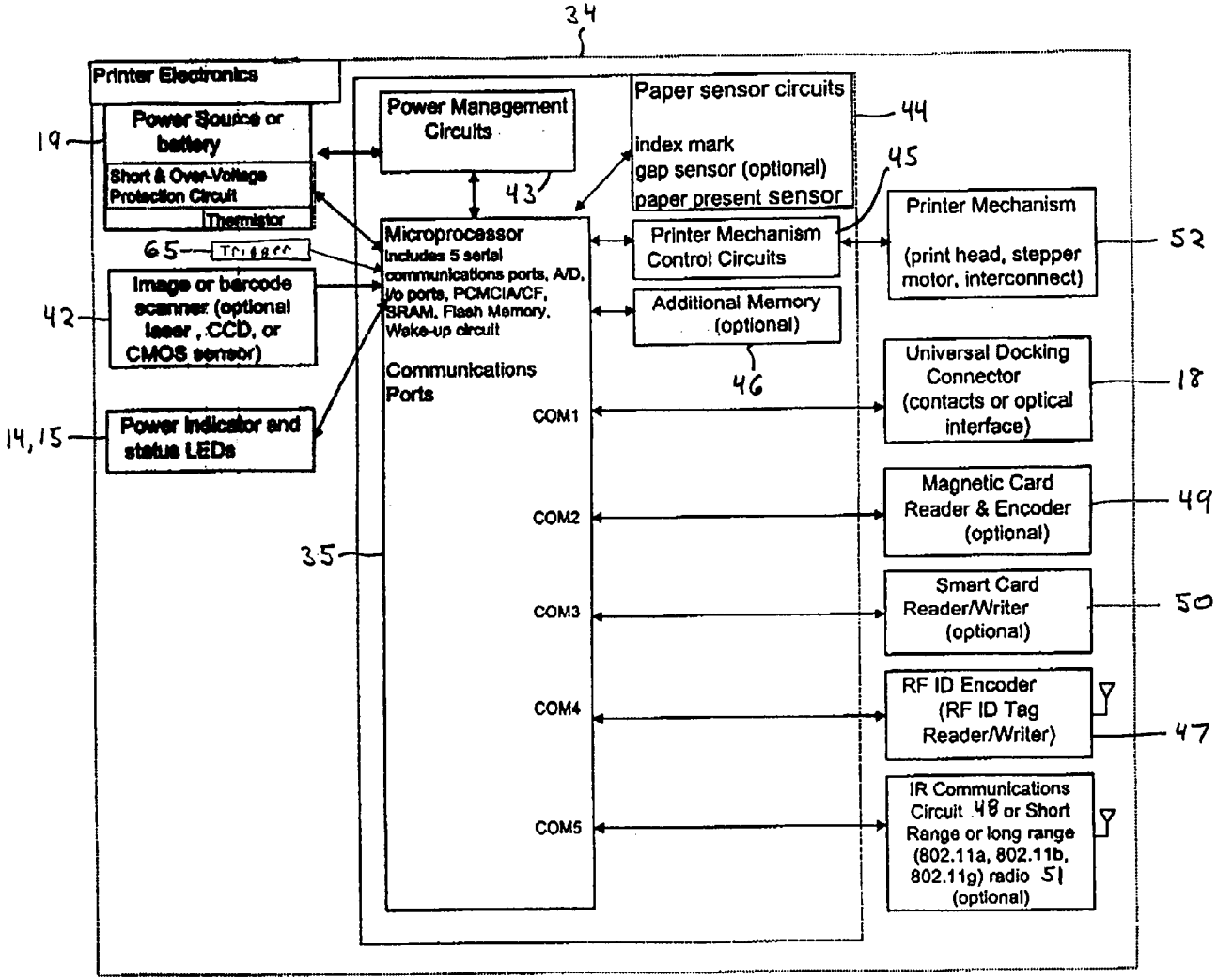
FIG. 4 is a schematic, block diagram of the universal clip-on printer in accordance with the present invention.

Referring to FIG. 4, a diagram of printer electronics 34 is shown having a microprocessor or micro-controller 35 connected to a power source, such as battery 19, optional image (or barcode) scanner 42, power indicator LED 14 and status indicator LED 15, power management circuits 43, paper sensor circuits 44, printer mechanism control circuits 45, optional additional memory 46. The microprocessor and micro-controller 35 is referred to hereinafter as controller 35. The optional input circuits which may be provided in housing 11 to facilitate data entry into the portable device 24 include: an IR circuit 48, magnetic card reader circuit 49, smart card reader/writer 50, radio (RF interface and antenna) 51, and an RFID Tag reader/writer 47. The radio 51 can be a short-range radio such as a Bluetooth type radio supplied by Ericsson, or a long-range wireless LAN (Local Area Network) radio adhering to the 802.11a or 802.11b type standards such as the Cisco Model 350 or Symbol Spectrum 24. Radio 51 or IR circuitry 48 may provide communication with other devices, such as a remote computer or server. Also, radio 51 and IR circuits 48 may provide an alternative input/output communication means for use by the portable device 24 through controller 35 when the portable device is attached to the portable printer via adapter 20. The RFID Tag reader/writer 47 may be such as described in U.S. Pat. No. 6,409,401, which is herein incorporated by reference. The magnetic or smart card readers may be used to input credit card or smart card information. The printer mechanism control circuits 45 are connected to the printer mechanism 52, which contains print head 12, stepper motor, and platen 21. The controller 35 is connected to universal docking controller 18.

Figure 4A:
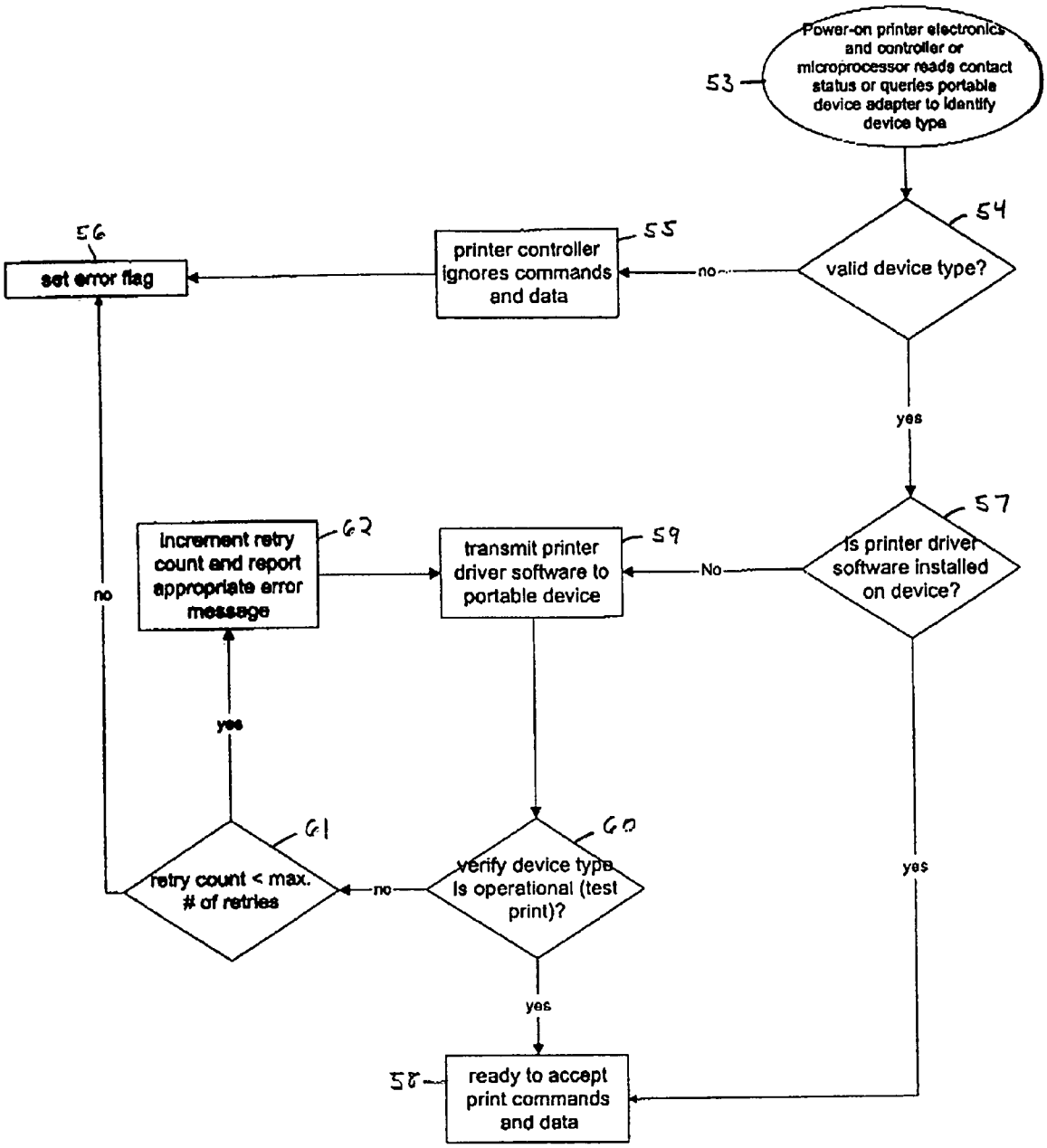
FIG. 4A is a flow-chart showing the software in the printer which adapts the universal clip-on printer to operate with the portable device attached thereto.

The software of the portable printer 8 may be in accordance with FIG. 4A to enable the detection of different universal docking connectors 18 (FIG. 4). The electronics 34 run similar printer software to that currently used to operate printers as for example, described in the above referenced patents and publications. The electronics 34 may be the same as described in U.S. Pat. No. 5,267,800 or 5,806,993, which are herein incorporated by reference. The cover, platen roller, and driving of the platen roller to advance paper from a roll of paper may be as described in U.S. Pat. No. 6,004,053, which is herein incorporated by reference. The media cover release latch 22 may be the same as described in U.S. patent application Ser. No. 10/035,496, filed Nov. 9, 2001.

The universal docking connector 18 may be constructed of physical contacts, such as conductive metal contacts, such as of copper. For example, universal docking connector 18 may represent spring-biased contacts sold by Bourns, Inc., Riverside Calif., under Model No. 70ADM, and mates with contacts of adapter docking connector 27 which may be of Model No. 70ADF. Universal docking connector 18 may have seven contacts as shown in FIG. 1A, for mating with a corresponding number of contacts of adapter docking connector 27 as shown in FIG. 1B, but other number of contacts may be used for these connectors. For instance, three contacts on the universal docking connector can be reserved to define the type of portable device adapter, allowing the software to select up to eight (8) possible portable devices. Depending on whether or not the individual contacts are set to a logical 0 or logical 1 state, usually controlled by either a pull-down resistor, pull-up resistor, or programmable register on the portable device adapter board, the portable device can be identified by controller 35. The controller 35 may also use query commands to the portable device 24 (or to electronics on the adapter board, if present) which can respond with the type of portable device (or an identifier associated with the type and/or model) of the portable device for use with the adapter.

Alternatively, universal docking connector 18 may utilize optical connections, such as infrared light, and optical interface communication protocol. For example, a common optical interface uses IrDA (Infrared Data Association) protocol to communicate with a portable device 24, which has a similar IrDA communications port, where connectors 26 and 27 also utilize optical connections.

Software running on the controller 35 can either read the status of the contacts or query the optical or physical connections, and enable the appropriate printer driver based on these contact settings or information identifying the portable device. The portable device 24 has a software driver operating on the printer to provide an interface, via an input means of the portable device, to the print engine 10 for enabling the user to control operation of the print engine. For example, such input means may be a graphics user interface having a display (e.g., touch screen) and/or keypad, or microphone (voice input), or radio, or other typical input means for a portable device of a PDA, cell phone, or other data handling terminal. Thus, the portable device can operate as a host system or terminal for the printer. If the printer software driver is not installed, the printer software driver can be transmitted to the portable device via the universal docking connector 18, where it is then runs on the portable device to control printing. Different software drivers may be loaded in memory of the printer for the different portable device types. The controller 35 can send information to the print head for printing on paper from the roll, in response to commands and data received from the portable device 24 when coupled to the printer 10 via adapter 20. Further, the controller 35 can send information to the portable device 24, such as image or decoded bar code data, or data received by any of the optional data entry facilities 42, 47–50, which may be displayed to the user via the display of the portable device 24. Such data entry facilities may represent optional peripherals that can be used to input data to the portable device 24, and in the case of facilities 47–50, provide data output from the portable device 24.

Referring to FIG. 4A, a flow chart is shown for the software in the print engine 10 for adapting the portable printer to operate with portable devices of various types, kinds, or models. With the adapter 20 mounted to the print engine 10, as described earlier, and the portable device 24 inserted in the adapter 20, the controller 35 reads the contact status or queries the portable device to identify the device type (step 53). This may occur when the printer is turned on. The read contact status may be compared to a look-up table in memory of controller 35 or memory 46 for associating the read contact status with the type of portable device 24, and to identify the software driver needed to be installed for enabling communication with the portable device 24. If a query command is used, the portable device 24 sends its device type to the controller 35 in response to the query command. If the device type is not valid, i.e., not found in the look-up-table (step 54), the controller ignores any commands or data which may have been received via universal docking connector 18 (step 55), or other communication interface (IR 48 or RF 51), and sets an error flag (step 56). If the portable device type is valid (step 54), the controller 35 checks the software loaded in the portable device 24 to determine if the printer driver software is installed (step 57). If installed, the print engine controller 35 is ready to accept print commands and data from the portable device 24 (step 58). If the printer driver software is not installed on the portable device 24 (step 57), software is transmitted (downloaded), such as using a PC software installation disk on a personal computer system typically programmed to communicate with the portable device, when coupled or docked thereto, such that the proper driver software for the portable device may be selected, transmitted and installed on the portable device (step 59). Alternatively at step 59, the driver software may be transmitted from memory of the printer by controller 35 (or requested by controller 35 as file(s) downloaded from a host computer server, via IR 48 or RF 51 communication interface, or cable connector of the print engine) to the portable device. This accounts for different portable devices possibly needing different software drivers installed for enabling operation with the print engine 10 and for the print engine 10 to account for any differences in communication protocols between different portable devices. Once software is installed, the controller 35 at step 60 verifies that the device type is operational (e.g., receives command and data of a test print). If the device type verifies, the controller 35 is ready to accept print commands and data from the portable device 24 (step 58), otherwise, the controller 35 retries transmitting the driver software at step 59 for a maximum (max) number of retries (step 61) and reports an error message (step 62). The max number of retries is a variable stored in memory of the controller 35 or memory 46 of the printer. For example, the maximum number of retries may be three. If after a max number of retries the device type does not verify, an error flag is set (step 56). If the error flag is set, the controller 35 may notify the user of the problem via status LED's.

Figure 5:
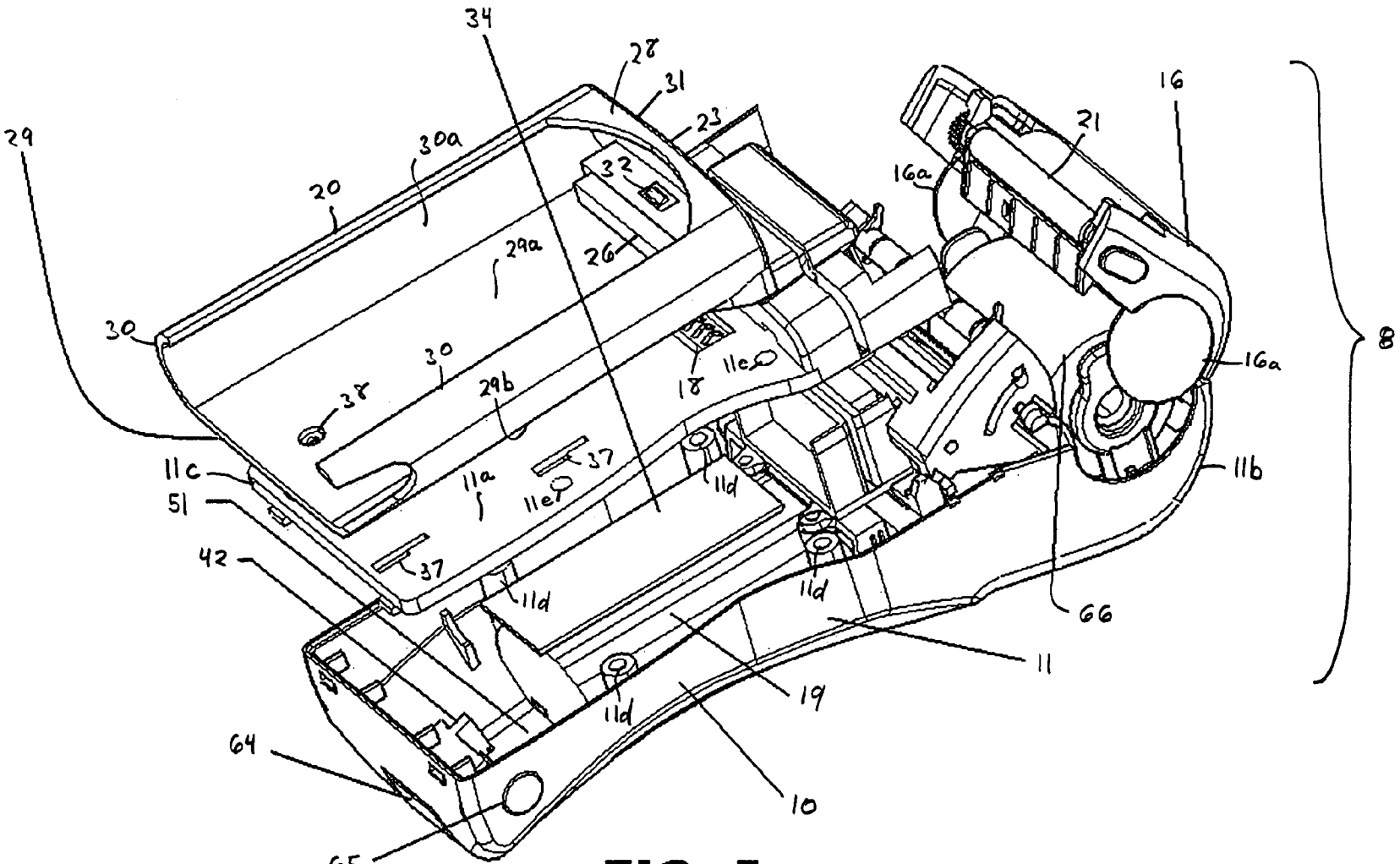
FIG. 5 is an isometric exploded view of the universal clip-on printer of FIG. 1 from a different perspective.

Referring to FIG. 5, the common print engine 10 houses the battery 19, optional image scanner 42, and media roll 66. The optional image scanner 42 can capture images via a window 64 located in an opening in the housing, and decode images, such as barcodes. Image scanner 42 may be a 1D linear or 2D array scanner, for capturing barcodes or graphics. As stated earlier, it can be used to facilitate data input to the portable device 24 when connected to the printer 10 via adapter 20 appropriate for the portable device. For example, image scanner 42 may be the Symbol model SE923, a charged coupled device (CCD), such as the Sony model ICX205P, Hand Held Products IT4000, or CMOS sensor with light source. The image scanner 42 can be activated using the optional scanner trigger 65. The housing 11 may have a lower housing section 11*b* and an upper housing section 11*c* which covers the lower housing section, and attached thereto by screws through holes 11*e* and molded threaded holes 11*d*. The cover 16 is pivotally connected by a hinge 17 (FIG. 1) to the lower housing section 11*b* to enable an operator to load a roll 66, such that the motor driven platen roller 21 can advance paper from the roll across the print head. The adapter 20 mounts via keys into slots, as described earlier, along the upper housing section 11*c*, thereby providing a facility for use with portable devices 24 via adapters 20 for the type and model of the portable device.

To use the print engine 10 with a different model, type, or kind of portable device 24, the user removes the adapter 20 from attachment to the print engine's housing 11 and replaces it with a different adapter 20 suitable for the different portable device 24. This may be easily achieved by the user pushing the adapter 20 in the direction of arrow 6 (FIG. 1) to position each of keys 36 from narrow slot opening 37*b* to extending opening 37*a* to release the adapter from the print engine 10. The adapter is then replaced with the different adapter 20 for the different portable device 24 to be used with the printer by locating the keys 36 of the adapter in slot openings 37*a*, and pushing the adapter in the direction of arrow 7 (FIG. 1) to position the neck 36*b* of each of the keys in slot openings 37*b*, thereby mounting the adapter 20 to the print engine 10. Each of the adapters 20, although for different portable devices, has similar keys 36 (and optional detenting latch(es) and adapter docking connector 27 for releasable attachment to and electrical connection with the print engine. A portable device 24 may be located or not located in an adapter 20 when the adapter is attached or detached from the print engine 10. Prior art portable printers do not utilize an adapter to easily clip on and remove from a printer for adapting the printer for use with different types or models of portable devices (e.g., PDA's, cell phones, portable hand-held computers, terminals, and the like).

The portable printer 8 is thus adaptable for attachment to any portable device 24 by using one of the multiple adapters 20 for the particular portable device a user desires to use with the print engine 10. Since the relatively inexpensive adapter 20 is the only part of portable printer 8 that requires redesign and retooling for different portable devices 24, users upgrading to newer portable devices 24 can use the same printer engine by simply purchasing a less expensive adapter, rather than replacing the entire printer. Further, a portable printer is readily convertible into a universal clip-on printer 8 without redesigning the entire printer, thus providing portable printers with the advantageous feature of universal adaptability and connectivity to portable devices 24. The portable printer 8 attached to portable device 24, such as a stand-alone terminal, is suitable for use as a secure printing device for such applications as airline, retail, hospitality, inventory control, warehousing, and other portable printing applications.

In summary, a portable printer 8 has been provided which is automatically adaptable and removably connectable in controlled or controlling relationship with a selected one of several model, types, and kinds of portable devices 24. The removable connectability is provided by adapters representing facilities that adapt the portable device to be mechanically and electrically attached to the printer engine 10. The adapters 24 may differ for each kind, type or model of portable device 24 to be connected but are common to the printer. The adapter 20 may represent separate sleds or clips and are unique to each model, type, or kind of portable device 24. Each portable device adapter 24 contains terminal-specific connectors and geometry, so that it can mount by either attaching to the top, bottom, or back surface of the portable device, which is to be attached in operating relationship with the printer. In addition, the adapter 20 contains the mating electrical connector(s) 27 to connector(2) 18 of the common print engine 10. A multitude of adapters are provided all having the same docking feature, such as extending key members 26, for releasable attachment to features, such as into slots 37, of the common printer engine 10. The adapter 20 can also include various electronics, such that the common printer engine software can automatically determine which portable device 24 is attached. Depending on the type of adapter that is attached, different printer driver software can be enabled. The portable device adapter 20 can be oriented to the common print engine 10, such that the paper exits from the bottom, top, left, or right surface relative to the portable device 24.

From the foregoing description, it will be apparent that there has been provided a universal clip-on portable printer having adapters enabling the printer to be attached for operation with different portable devices. Variations and modifications in the herein described portable printer in accordance with the invention will undoubtedly suggest themselves to those skilled in the art. Accordingly, the foregoing description should be taken as illustrative and not in a limiting sense.

What is claimed is:

1. A portable printer comprising:

a housing;

one of a plurality of adapters releasibly attached to said housing, in which each of said adapters is capable connecting a different portable device for communication with said portable printer; and a controller for determining the type of portable device connected to said portable printer by one of said plurality of adapters attached to said housing.

2. The portable printer according to claim 1 wherein each of said plurality of adapters enables attachment to said housing.

3. The portable printer according to claim 1 wherein each of said plurality of adapters releasibly holds a different kind or model of portable device.

4. The portable printer according to claim 1 further comprising a common print engine in said housing for use with different ones of said portable device when connected to said printer by one of said plurality of adapters.

5. The portable printer according to claim 1 wherein the different portable device for each of said adapter represents one of a plurality of portable devices of similar kind, model, or type capable of use with the adapter.

6. The portable printer according to claim 1 wherein one or more of said plurality of adapters represents a cradle or sled.

7. The portable printer according to claim 1 further comprising:

means for printing in said housing;

means for controlling said printing means in said housing; and means for communication between said controlling means and the portable device connected by one of said plurality of adapters to said portable printer.

8. The portable printer according to claim 7 wherein said communication means is operative by electrical, optical, or RF connecting means in each of said plurality of adapters when attached to said housing.

9. The portable printer according to claim 7 wherein said communication means further comprises a first connector on said housing in communication with said controlling means, and each of said adapters further comprises second and third connectors coupled to each other for communication, in which said second connector is connectable to said first connector when the adapter is attached to said housing, and said third connector is connectable to the portable device for the adapter, thereby enabling communication between said portable device and said portable printer through said first, second, and third connectors.

10. The portable printer according to claim 9 wherein one or more of said first, second, and third connectors are electrically or optically operative for communication.

11. The portable printer according to claim 9 wherein said portable device has a communication port and said third connector is adapted for mating with said communication port of said portable device.

12. The portable printer according to claim 11 wherein each of said adapters has a profile adapted to receive the portable device for the adapter and to align the communication port of the portable device for connection to said third connector of the adapter.

13. The portable printer according to claim 11 wherein said third connector is electrically or optically operative for connection with the communication port of the portable device.

14. The portable printer according to claim 7 wherein said controlling means further comprises means for determining when the portable device, connected to said portable printer by one of said plurality of adapters attached to said housing, has driver software for enabling communication with said portable printer.

15. The portable printer according to claim 1 wherein said portable device represents one of a PDA, cell phone, portable data handling terminal, or hand-holdable computer.

16. The portable printer according to claim 1 wherein each of said plurality of adapters is shaped to receive a different kind or model of portable device for the respective adapter.

17. The portable printer according to claim 1 wherein said housing has means for printing information on media, in which the orientation of printed information on said media with respect to the portable device is different for one or more different ones of said plurality of adapters.

18. The portable printer according to claim 1 wherein said portable device connected to said portable printer by one of said plurality of adapters operates said portable printer in a controlling relationship.

19. The portable printer according to claim 1 wherein said housing has one or more slots, and each of said plurality of adapters comprises one or more members extending from the adapter into releasable engagement with corresponding slots along said housing to releasibly attach the adapter to the housing.

20. The portable printer according to claim 1 wherein said housing further comprises means for communication in said housing capable of being used by said portable device when attached to said housing.

21. The portable printer according to claim 20 wherein said communication means is operative by RF or optical communication to devices other than said printer.

22. The portable printer according to claim 1 wherein said housing further comprises means for inputting or outputting data.

23. The portable printer according to claim 1 wherein one or more of said plurality of adapters has means for latching the portable device to the adapter.

24. The portable printer according to claim 1 wherein said housing and said adapter when attached to said housing weigh less than 2 pounds.

25. The portable printer according to claim 1 wherein each of said plurality of adapters comprises two connectors coupled to each other to enable communication between said printer and the portable device, wherein said portable printer and the portable device each interface to different ones of said connectors when the adapter is attached to said housing.

26. The portable printer according to claim 1 wherein said adapter has at least one surface fixably mounted stationary to said housing.

27. A portable printer according to claim 1, wherein said housing further comprises one or more of an image scanner, barcode scanner, and an RFID Tag reader/writer located in said housing.

28. A portable printer comprising:

a housing;

one of a plurality of adapters releasibly attached to said housing, in which each of said adapters is capable connecting a different portable device for communication with said portable printer;

means for printing in said housing;

a controller for controlling said printing means in said housing; and means for communication between said controller and the portable device connected by one of said plurality of adapters to said portable printer;

wherein said controller is capable of automatically transmitting driver software for enabling communication with the portable device when the portable device is connected to said printer by one of said plurality of adapters attached to said housing.

29. A portable printer according to claim 28, wherein said housing further comprises one or more of an image scanner, barcode scanner, and an RFID Tag reader/writer located in said housing.

30. A portable printer comprising:

a housing for a portable printer; and one of a plurality of adapters releasibly attached to said housing, in which each of said adapters is capable of connecting a different portable device for communication with said portable printer, wherein said housing further comprises means for inputting or outputting data, said inputting or outputting data means comprises one or more of an image scanner, barcode scanner, and an RFID Tag reader/writer located in said housing for communicating with at least one of said printer and said portable devices connected to said housing.

31. A method of providing a portable printer comprising the steps of:

attaching a portable device adapter to a portable printer, in which said portable device adapter represents one of plurality of adapters for use with different types, kinds, or models of portable devices;

locating a portable device in the portable device adapter to provide one of electrical, RF, or optical connection between said portable device and said portable printer; and determining the type of portable device connected to said portable printer by one of said plurality of adapters attached to said portable printer.

32. The method according to claim 31 further comprising the steps of:

communicating commands and data between said portable device and portable printer in accordance with said type of portable device.

33. The method according to claim 31 further comprising the steps of:

replacing the portable device adapter with a different portable device adapter for attachment to the portable printer; and locating another portable device in said different portable device adapter, and repeating said determining and communicating steps with said another portable device.

34. A method according to claim 31, wherein said portable printer comprises one or more of an image scanner, barcode scanner, and an RFID Tag reader/writer located in said portable printer, and wherein said method further comprises communicating between one or more of said image scanner, barcode scanner, and RFID Tag reader/writer and one of said printer and said portable devices connected to said portable printer.

35. A portable printer for printing information on media comprising:

a housing having means for printing information on media and a controller for controlling said printing means; and means for releasibly attaching a portable device to said housing for communication with said controller, said releasibly attaching means comprises an adapter for receiving said portable device comprising means for enabling communication between said portable device and said controller, in which said adapter represents ones of a plurality of adapters attachable to said housing to enable attachment of different portable devices, wherein said controller determines the type of portable device connected to said portable printer by one of said plurality of adapters attached to said housing.

36. The portable printer according to claim 35 wherein the portable device represents one of a PDA, cell phone, portable data handling terminal, or hand-holdable computer.

37. The portable printer according to claim 35 wherein said adapter provides a housing for receiving the portable device and said housing has means for releasibly attaching the adapter to the housing of the printer.

38. The portable printer according to claim 35 further comprising means for enabling communication between said controller and said portable device for enabling information to be sent from said printing means to the portable device.

39. The portable printer according to claim 35 wherein said adapter has at least one surface fixably mounted stationary to said housing.

40. A portable printer comprising a print engine in a housing, and a plurality of adaptors, having attachments or clips, each specific to a different type of terminal or portable device and each commonly connectable to said housing, said attachments or clips enabling attachment of said different kinds of terminals or devices to said printer and a controller for determining the type of portable device connected to said portable printer by one of said plurality of adapters attached to said housing.

41. The portable printer according to claim 40 further comprising means operated by said attachments or clips for enabling the terminal or device specific thereto to be in controlled or controlling relationship with said printer.

42. The portable printer according to claim 40 further comprising communication means in said housing capable of being used by said portable device.

43. The portable printer according to claim 42 wherein said communication means is operative by RF or optical communication to devices other than said printer.

44. The portable printer according to claim 40 further comprising data input or output means in said housing capable of being used by said portable device.

45. A portable printer comprising:

a housing; and an adapter releasibly attachable to said housing, in which said adapter is capable of connecting a portable device for communication with said portable printer, and said adapter comprises means for providing information to said printer which characterizes the portable device used in the adapter, wherein said means further comprises electronics in said adapter separate from said portable device which stores said information.

46. The portable printer according to claim 45 wherein said means further comprises a connector to said portable printer having a plurality of contacts, and said information is provided to said portable printer in the state of one or more of said contacts being logical zero or one.

47. The portable printer according to claim 45 wherein said adapter represents one of a plurality of adapter each releasibly attachable to said housing of said portable printer for connecting different portable devices for communication with said portable printer.

48. A portable printer according to claim 45, wherein said housing further comprises one or more of an image scanner, barcode scanner, and an RFID Tag reader/writer located in said housing.

49. A portable printer comprising:

a housing;

at least one adapter releasibly attached to said housing, said adapter comprising a connector for connecting said housing; and a controller located in said housing, said controller is capable of determining the type of portable device connected to said portable printer based on the configuration of said adapter.

50. A portable printer according to claim 49, wherein said connector comprises a plurality of electrical contacts, wherein said contacts identify the type of portable device associated with the portable device.

51. A portable printer according to claim 49, wherein said connector comprises a plurality of electrical contacts, wherein a configuration of said contacts identifies the type of portable device associated with the portable device.

52. A portable printer according to claim 49, wherein said connector comprises a plurality of electrical contacts, wherein said contacts are selectively powered to thereby identify the type of portable device associated with the portable device.

53. A portable printer according to claim 49, wherein said housing further comprises one or more of an image scanner, barcode scanner, and an RFID Tag reader/writer located in said housing.

54. A portable printer comprising:

a housing for a portable printer; and one of a plurality of adapters releasibly attached to said housing, in which each of said adapters is capable of connecting a different portable device for communication with said portable printer, wherein said housing further comprises an RFID Tag reader/writer located in said housing for communicating with at least one of said printer and said portable devices connected to said housing.

* * * * *